US008982674B2

(12) United States Patent
Mahler et al.

(10) Patent No.: US 8,982,674 B2
(45) Date of Patent: Mar. 17, 2015

(54) DEVICE FOR CORRECTING A TIMEPIECE DISPLAY MECHANISM

(75) Inventors: Olivier Mahler, Boécourt (CH); Salvatore Dettori, Savagnier (CH)

(73) Assignee: Omega SA, Bienne (CH)

( * ) Notice: Subject to any disclaimer, the term of this patent is extended or adjusted under 35 U.S.C. 154(b) by 837 days.

(21) Appl. No.: 12/663,140

(22) PCT Filed: Jun. 2, 2008

(86) PCT No.: PCT/EP2008/056776
§ 371 (c)(1),
(2), (4) Date: May 24, 2010

(87) PCT Pub. No.: WO2008/148735
PCT Pub. Date: Dec. 11, 2008

(65) Prior Publication Data

US 2010/0226215 A1 Sep. 9, 2010

(30) Foreign Application Priority Data

Jun. 4, 2007 (EP) ..... 07109530

(51) Int. Cl.
*G04B 19/20* (2006.01)
*G04B 19/25* (2006.01)
*G04B 27/00* (2006.01)

(52) U.S. Cl.
CPC ..... *G04B 19/25* (2013.01); *G04B 27/001* (2013.01)
USPC ..... 368/35; 368/190

(58) Field of Classification Search
USPC ..... 368/190, 35, 37, 28, 191
See application file for complete search history.

(56) References Cited

U.S. PATENT DOCUMENTS

| | | | | |
|---|---|---|---|---|
| 196,252 | A | 10/1877 | Robottom | |
| 3,043,090 | A | 7/1962 | Sundt | |
| 4,254,493 | A * | 3/1981 | Billet | 368/185 |
| 6,711,100 | B2 * | 3/2004 | Rochat et al. | 368/35 |
| 7,027,360 | B2 * | 4/2006 | Kitahara et al. | 368/28 |

(Continued)

FOREIGN PATENT DOCUMENTS

| | | |
|---|---|---|
| FR | 2 283 477 | 3/1976 |
| JP | 54-106271 | 8/1979 |

OTHER PUBLICATIONS

International Search Report issued in corresponding application No. PCT/EP2008/056776, completed Oct. 30, 2008 and mailed Nov. 5, 2008.

*Primary Examiner* — Sean Kayes
(74) *Attorney, Agent, or Firm* — Griffin & Szipl, P.C.

(57) ABSTRACT

The invention relates to a device for correcting a time indication given by a display mechanism for a timepiece of the type comprising a first display member, comprising:

a winding stem arranged to occupy at least one time indication correction position A, a pinion coupled in rotation to the winding stem, a correction motion transfer connected kinematically to the pinion when the stem is occupying the correction position A, and a correction wheel assembly engaging with the display member and operated by the correction motion transfer. According to the invention, the correction motion transfer is formed by a ring having an internal circumference and an external circumference, at least one of which is provided with teeth meshing at least indirectly with said correction wheel assembly.

17 Claims, 3 Drawing Sheets

(56) References Cited

U.S. PATENT DOCUMENTS

| | | | | |
|---|---|---|---|---|
| 7,170,826 | B2 * | 1/2007 | Furukawa et al. | 368/80 |
| 7,218,576 | B1 * | 5/2007 | Bron | 368/35 |
| 7,254,094 | B2 * | 8/2007 | Watanabe | 368/37 |
| 7,433,272 | B2 * | 10/2008 | Watanabe | 368/37 |
| 7,742,364 | B2 * | 6/2010 | Hiraga et al. | 368/80 |
| 2005/0174891 | A1 * | 8/2005 | Besse | 368/37 |
| 2007/0177464 | A1 * | 8/2007 | Watanabe | 368/37 |
| 2010/0002545 | A1 * | 1/2010 | Kitahara et al. | 368/37 |

* cited by examiner

EXHIBIT A

AA
10
54
26
30
A
52
B
24
22
20
56
62
58
60
50

CC
58
64a
20
26

BB
10
60
58
76
26
20
62
24
30
X
X
74
78
70
66
72
68
24
20
63
58
26

DEVICE FOR CORRECTING A TIMEPIECE DISPLAY MECHANISM

This is a National Phase Application in the United States of International Patent Application PCT/EP 2008/056776 filed Jun. 2, 2008, which claims priority on European Patent Application No 07109530.1 of Jun. 4, 2007. The entire disclosures of the above patent applications are hereby incorporated by reference.

FIELD OF THE INVENTION

The present invention relates to the field of horology. More specifically, it concerns a device for correcting a mechanism displaying a time indication, such as a date, day of the week, month etc.

BACKGROUND OF THE INVENTION

Mechanisms displaying a time indication generally include one or more display members, such as discs or rings, actuated in rotation by a drive mechanism. Corrections devices for such display mechanisms are well known to those skilled in the art. They mainly include a winding stem arranged to occupy at least one time indication correcting position, a pinion that is secured in rotation to the winding stem, an intermediate wheel meshed with the pinion when the stem is in the correcting position and a corrector wheel set which is activated by the intermediate wheel and cooperates with a first display member. The unit is generally mounted on a bottom plate, on the dial side.

When the display mechanism has two display members, the corrector wheel set is slidably mounted between two correcting positions, so that the change from one correcting position to the other occurs by reversing the direction of rotation of the winding stem. Thus, the corrector wheel set is, for example, mounted on a lever actuated by the intermediate wheel. The assembly formed by the intermediate wheel, the lever and the corrector wheel set is located at 3 o'clock, in proximity to the winding stem. It takes up a considerable amount of space, which makes it inconvenient to incorporate if there are other parts in proximity to the winding stem. This is the case, particularly, when chronograph counter arbours pass through the bottom plate in proximity to the winding stem. The space available for the display mechanism corrector device is thus greatly limited.

One solution to this difficulty consists in moving the lever-corrector wheel set unit to another section of the bottom plate, for example, to 9 o'clock, using a series of intermediate wheels, which are mounted to rotate freely about the arbours of the various counters. This solution takes a great deal of space on the bottom plate. It is difficult to implement if the plate is already occupied by a drive mechanism.

The present invention overcomes this drawback, by proposing a device for correcting the time indication of a display mechanism, wherein the lever-corrector wheel set unit is moved to one of the 9 o'clock, 6 o'clock or 12 o'clock sectors of the plate, thereby releasing useful space on the plate.

SUMMARY OF THE INVENTION

In particular, the invention broadly concerns a device for correcting a time indication provided by a timepiece display mechanism of the type including a first display member that has:

a winding stem arranged to occupy at least one time indication correcting position, a pinion mounted on the winding stem and secured in rotation thereto, an intermediate corrector wheel that is kinematically connected to the pinion when the stem is occupying the correcting position, and a corrector wheel set that cooperates with the display member and is actuated by the intermediate corrector wheel, characterized in that the intermediate corrector wheel is formed of a ring with an inner circumference and an outer circumference, at least one of which has a toothing that meshes, at least indirectly, with the corrector wheel set.

Owing to its ring-shaped geometry, the intermediate corrector wheel frees space inside its inner circumference, which means that parts, for example counter arbours, can be housed therein. Moreover, if the diameter of the intermediate corrector wheel is large compared to the other parts of the correction device, the lever-corrector wheel set unit can be moved away from the immediate vicinity of the winding stem, thereby freeing a significant amount of space inside the intermediate corrector wheel. In one advantageous embodiment, the intermediate corrector wheel surrounds all of the counter arbours, and moves the lever-corrector wheel set unit to 9 o'clock.

More specifically, in accordance with a first illustrative embodiment of the present invention, a device (14) is provided for correcting a time indication, supplied by a display mechanism (12) for a timepiece, of the type including a first display member (20) that includes: (a) a winding stem (50) arranged to occupy at least one time indication correcting position (A), (b) a pinion (52) that is mounted on the winding stem (50) and secured thereto in rotation, (c) an intermediate corrector wheel (58) kinematically connected to the pinion (52) when the stem (50) is occupying the correcting position (A), and (d) a corrector wheel set (68) that cooperates with the display member (20) and is actuated by the intermediate corrector wheel (58), characterized in that the intermediate corrector wheel (58) is formed of a ring (60) with an inner circumference and an outer circumference, at least one of which is fitted with a toothing (62), which is meshed, at least indirectly, with the corrector wheel set (68). In accordance with a second illustrative embodiment of the present invention, the first illustrative embodiment is modified so that the intermediate corrector wheel (58) is guided in rotation by one of the inner or outer circumferences thereof. In accordance with a third illustrative embodiment of the present invention, the first illustrative embodiment is modified so that the intermediate corrector wheel (58) is guided in rotation by a rib secured to the ring (60).

In accordance with a fourth illustrative embodiment of the present invention, the first, second and third illustrative embodiments are further modified so that it is mounted on a bottom plate (10) through which several arbours (15, 16, 18) pass, and in that the intermediate corrector wheel (58) is mobile in rotation about at least one of the arbours (16). In accordance with a fifth illustrative embodiment of the present invention, the fourth illustrative embodiment of the invention is modified so that the bottom plate (10) is traversed by three arbours (15, 16, 18), one (15) of which is centred relative to the bottom plate (10), and the two others (16, 18) are off-centre, and in that the intermediate corrector wheel (58) is mobile in rotation about the three arbours (15, 16, 18). In accordance with a sixth illustrative embodiment of the present invention, the fifth illustrative embodiment is further modified so that the display member (20) is formed of a ring (22) and in that the diameter of the intermediate corrector wheel (58) is close to that of the display member (20). In accordance with a seventh illustrative embodiment of the present invention, the sixth illustrative embodiment is further modified so that the corrector wheel set (68) is arranged at approximately 9 o'clock on the bottom plate (10).

In accordance with an eighth illustrative embodiment of the present invention, the fourth illustrative embodiment is further modified so that the intermediate corrector wheel (58) is mobile in rotation about a single off-centre arbour (16). In accordance with a ninth illustrative embodiment of the present invention, the eighth illustrative embodiment is further modified so that the display member (20) is formed of a ring (22), and in that the diameter of the intermediate corrector wheel (58) is close to that of the display member (20). In accordance with a tenth illustrative embodiment of the present invention, the ninth illustrative embodiment is further modified so that the corrector wheel set (68) is arranged at approximately 6 o'clock on the bottom plate (10).

In accordance with an eleventh illustrative embodiment of the present invention, the first, second, third, fourth, fifth, sixth, seventh, eighth, ninth and tenth illustrative embodiments are further modified so that the corrector wheel set (68) is slidably mounted between a first position (A') where it cooperates with the first display member (20) and a second position (B') where it cooperates at least indirectly with a second display member. In accordance with a twelfth illustrative embodiment of the present invention, the eleventh embodiment is further modified so that the corrector wheel set (68) is mounted on a lever (70). In accordance with a thirteenth illustrative embodiment of the present invention, the eleventh illustrative embodiment is further modified so that the corrector wheel set (68) is slidably mounted in an oblong hole.

BRIEF DESCRIPTION OF THE DRAWINGS

Other features and advantages of the present invention will appear more clearly from the following detailed description of an example embodiment of a display mechanism correction device according to the invention. This example is given purely by way of non-limiting illustration, with reference to the annexed drawing, in which.

DETAILED DESCRIPTION OF THE ILLUSTRATIVE EMBODIMENTS

Figure 1:
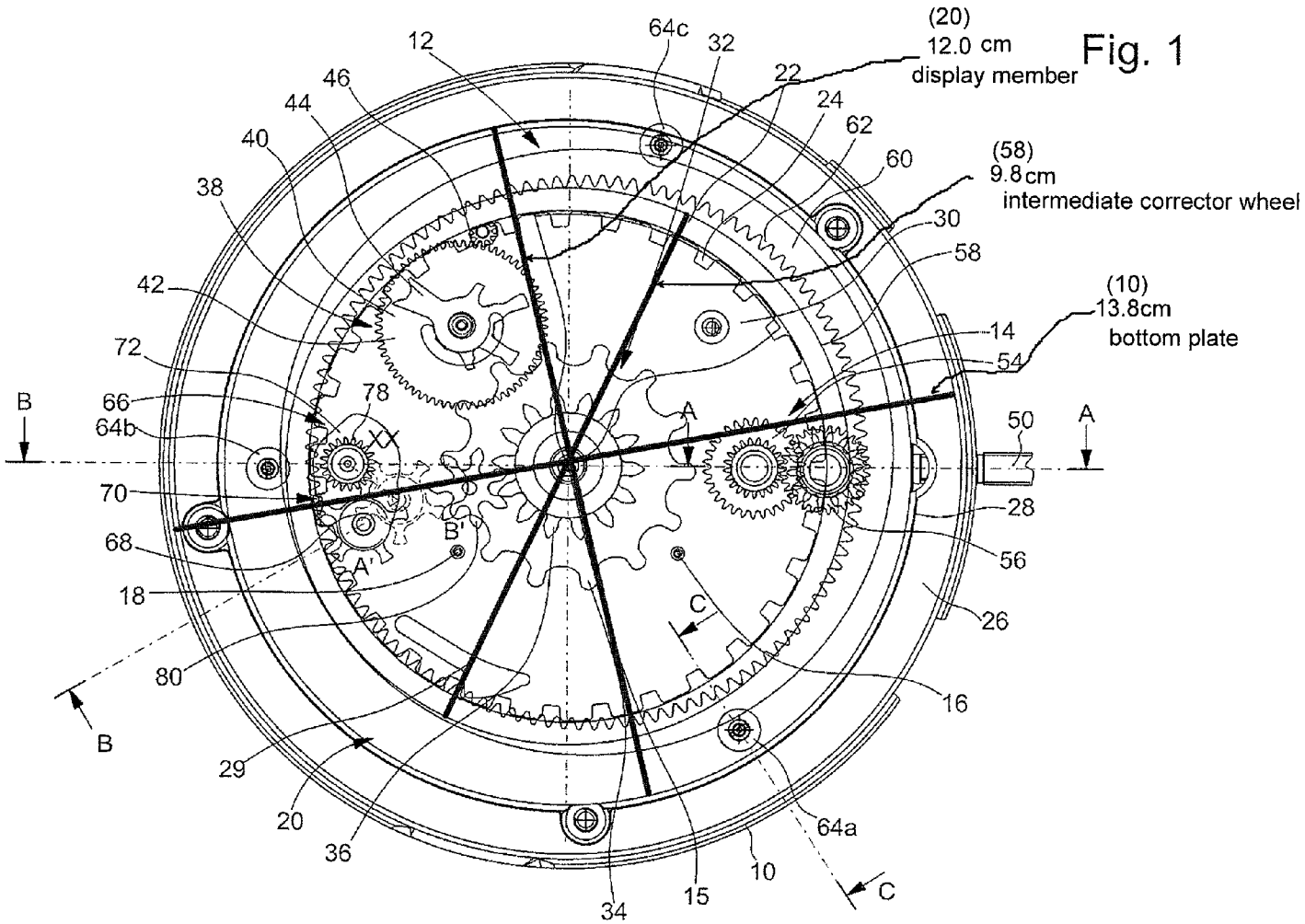
FIG. 1 is a top view of a correction device according to the invention.

FIG. 1 shows a bottom plate 10 for a timepiece, on which there are mounted, on one side, a mechanical or electromechanical movement (not shown), fitted with a chronograph mechanism, and, on the other side, a time indication display mechanism 12 and its correction device 14. A central arbour 15 for carrying hour and minute display members (not shown) and two arbours 16 and 18, respectively located at 4 o'clock and 8 o'clock, belonging to minute and hour counters of the chronograph mechanism, pass through bottom plate 10.

The time indication display mechanism 12 is of a conventional type. It has a digital date indicator 20, formed of a ring 22 fitted with an inner toothing 24. The date indicator 20 is mounted on a calendar plate 26, which is screwed to plate 10 and has a recess 28 provided for this purpose. It is angularly positioned by a jumper spring 29 and held axially and guided in rotation by a retaining plate 30, which is secured to calendar plate 26. Display mechanism 12 also includes a day display member, such as a hand, which is not visible in FIG. 1. The day display member is mounted at the centre of plate 10 and secured to a wheel set 32 formed of a day star wheel 34 and a correction star wheel 36.

The date indicator 20 and the day display member are driven in rotation by a drive mechanism 38, which is located at 11 o'clock and includes a drive wheel set 40, formed of a wheel 42 and a finger 44, secured to each other in rotation. Finger 44 cooperates with toothing 24 and also with day star wheel 34. Wheel 42 is driven by a pinion 46 that is kinematically connected to the movement by an arbour that passes through plate 10.

The display mechanism 12 thus described is positioned behind a dial (not shown). It can display the date, through a first aperture made in the dial, and the corresponding day of the week, via the day hand, which cooperates with day indications affixed to the dial.

Figure 2:
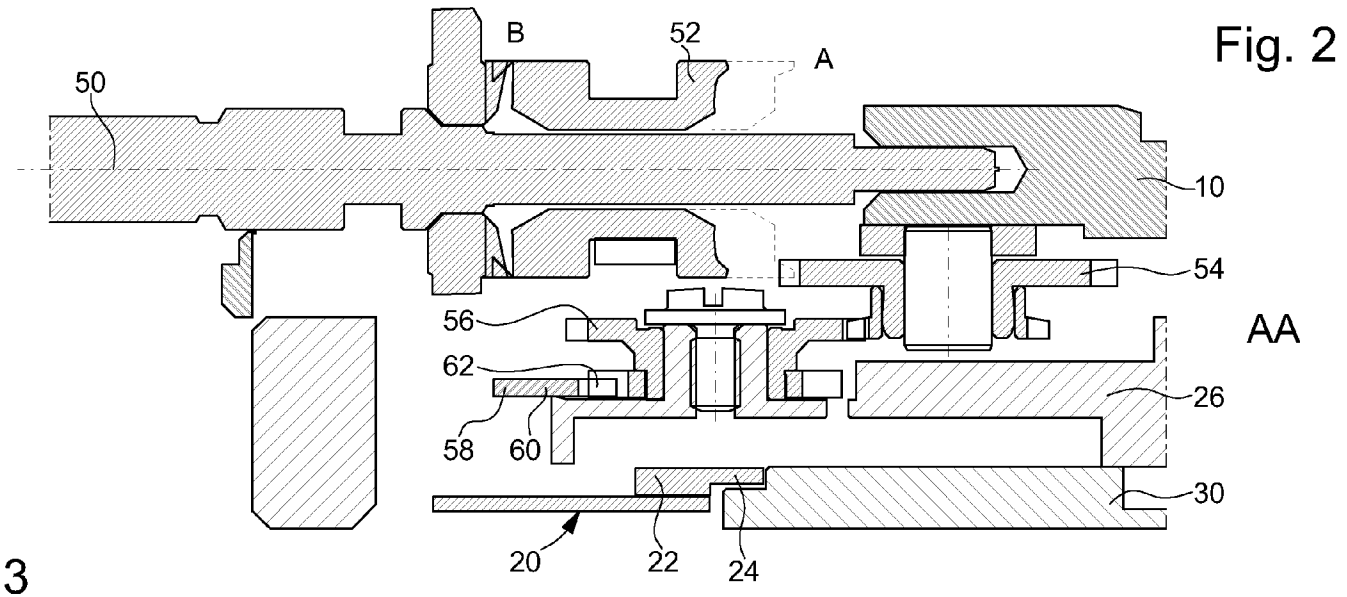
FIGS. 2 to 4 are cross-sections of the device along the respective axes AA, BB and CC.
Figure 4:
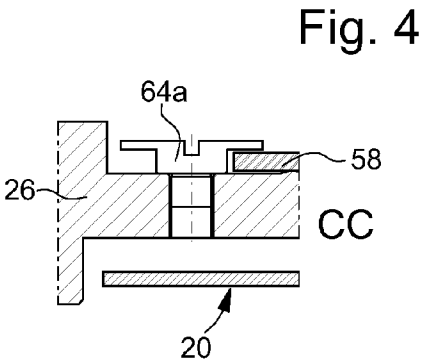
Figure 3:
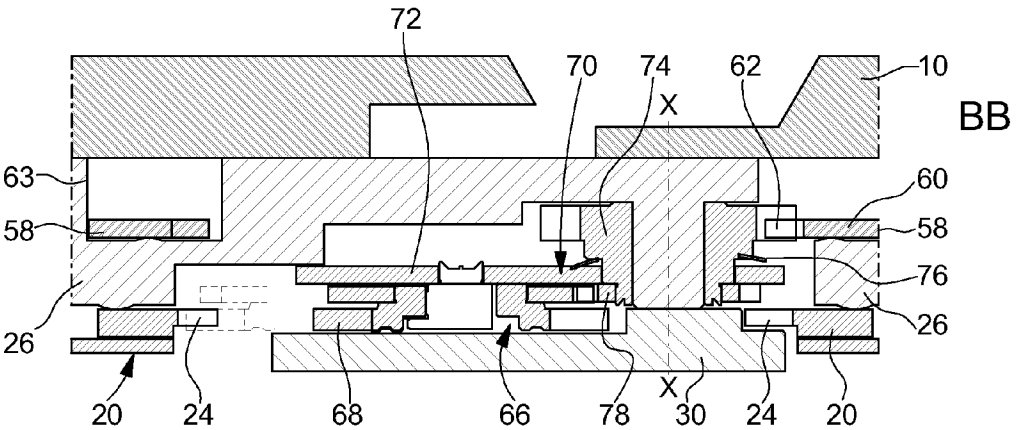

Reference will now usefully be made to FIGS. 2 to 4, which illustrate the correction device 14, seen along cross-sections AA, BB and CC. Correction device 14 of display mechanism 12 has, in a conventional manner, a winding stem 50, which is guided in rotation in plate 10. A sliding pinion 52 is secured in rotation to winding stem 50, and can move between a correcting position A and a winding position B. In correcting position A, it meshes with a first intermediate wheel 54, which is mounted to rotate freely on plate 10, and meshed with a second intermediate wheel 56, mounted to rotate freely on calendar plate 26.

The second intermediate wheel 56 is meshed with an intermediate corrector wheel 58, formed of a ring 60 with an inner toothing 62. Intermediate corrector wheel 58 is guided in rotation by its outer circumference, on calendar plate 26. A recess 63 is provided for this purpose in calendar plate 26. It is also held axially by three shouldered screws 64*a*, 64*b*, 64*c*, which are distributed angularly on the periphery thereof. The diameter of intermediate corrector wheel 58 is close to the diameter of date indicator 20, and it is positioned approximately centred about arbours 15, 16 and 18 of the various elements of drive mechanism 38 and correction device 14.

Intermediate corrector wheel 58 actuates a double corrector 66 mounted at 9 o'clock on calendar plate 26, and formed of a corrector wheel set 68 mounted on a lever 70. Lever 70 is pivotably mounted between first and second correcting positions, respectively A' and B', about a pivoting axis XX perpendicular to bottom plate 10. It includes a plate 72 mounted on a control wheel 74, whose axis of rotation merges with pivoting axis XX, meshed with intermediate corrector wheel 58. Control wheel 74 is also partially secured to plate 72 via a friction spring 76. A pinion 78 is mounted on plate 72, secured in rotation to control wheel 74, meshed with corrector wheel set 68. In first correcting position A', the corrector wheel set meshes with toothing 24 of date indicator 20, and in second correcting position B', it meshes with an intermediate star wheel 80, which is meshed with correction star wheel 36. In a variant of this embodiment, corrector wheel set 68 is slidably mounted in an oblong hole made in calendar plate 26, in accordance with a technique well known to those skilled in the art.

It will be noted that the correction device 14 thus described has two important advantages compared to a conventional device. First of all, the ring-shaped geometry of intermediate corrector wheel 58 frees space at the centre thereof. This space is occupied, in this case, by parts belonging to drive mechanism 38, correction device 14 and by arbours 15, 16 and 18. Secondly, the intermediate corrector wheel 58 has a diameter close to that of the date indicator 20. In example, the intermediate corrector wheel 58 has a diameter of two-thirds of the diameter of bottom plate 10. Because the diameters of the drive mechanism and the date indicator are close, intermediate corrector wheel 58 can move double corrector 66, which cannot be mounted in proximity to winding stem 50, because of the presence of minute counter arbour 16 at 4 o'clock. In the present case, double corrector 66 is moved to 9 o'clock, but it could also be at 6 o'clock or 12 o'clock, or any other place on bottom plate 10 free to receive it. Moreover, double corrector 66 is moved relative to bottom plate 10, without any useful space being lost on the plate. This arrangement of correction device 14 is advantageous for a bottom plate 10 that is pierced with several arbours, practically whatever the position of the arbours. It will be seen below that other arrangements of correction device 14 may be envisaged for particular arbour positions.

The operation of correction device 14 is as follows. When winding stem 50 is actuated clockwise, with sliding pinion 52 in correction position A, first intermediate wheel 54 is driven anti-clockwise, and it thus drives second intermediate wheel 56 clockwise. Wheel 56 meshes with intermediate corrector wheel 58, which is rotating clockwise, and in turn drives control wheel 74 of lever 70 clockwise. Control wheel 74 pivots plate 72 under the effect of friction wheel 76, until intermediate corrector wheel set 68 meshes with date indicator 20. Control wheel 74 is then uncoupled from plate 72, and actuates corrector wheel set 68 via pinion 78. Corrector wheel set 68 corrects date indicator 20 by rotating it anti-clockwise. When winding stem 50 is actuated anti-clockwise, with the sliding pinion in correction position A, the set of intermediate wheels 54, 56, 58 rotate in the opposite direction to the preceding direction, and lever 70 pivots anti-clockwise until corrector wheel set 68 meshes with intermediate star wheel 80. The latter drives correction star wheel 36 clockwise, thus allowing correction of the day display member.

Figure 5:
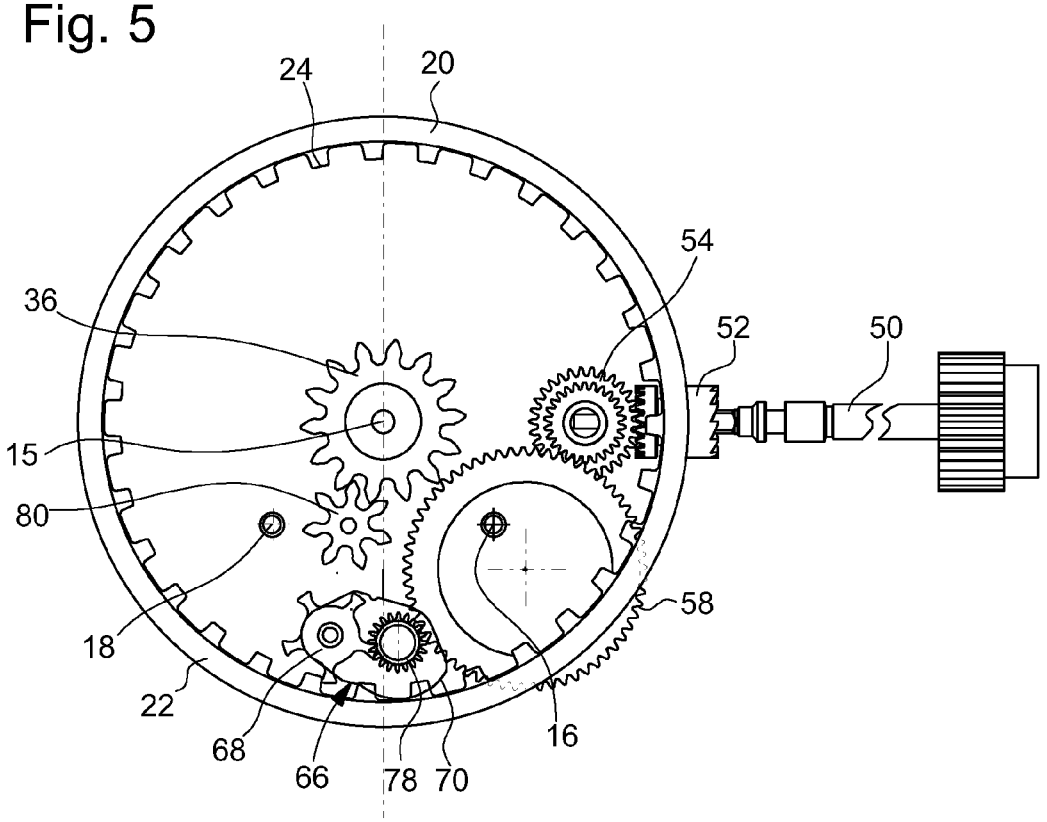
FIGS. 5 and 6 are variants of the correction device according to the invention.
Figure 6:
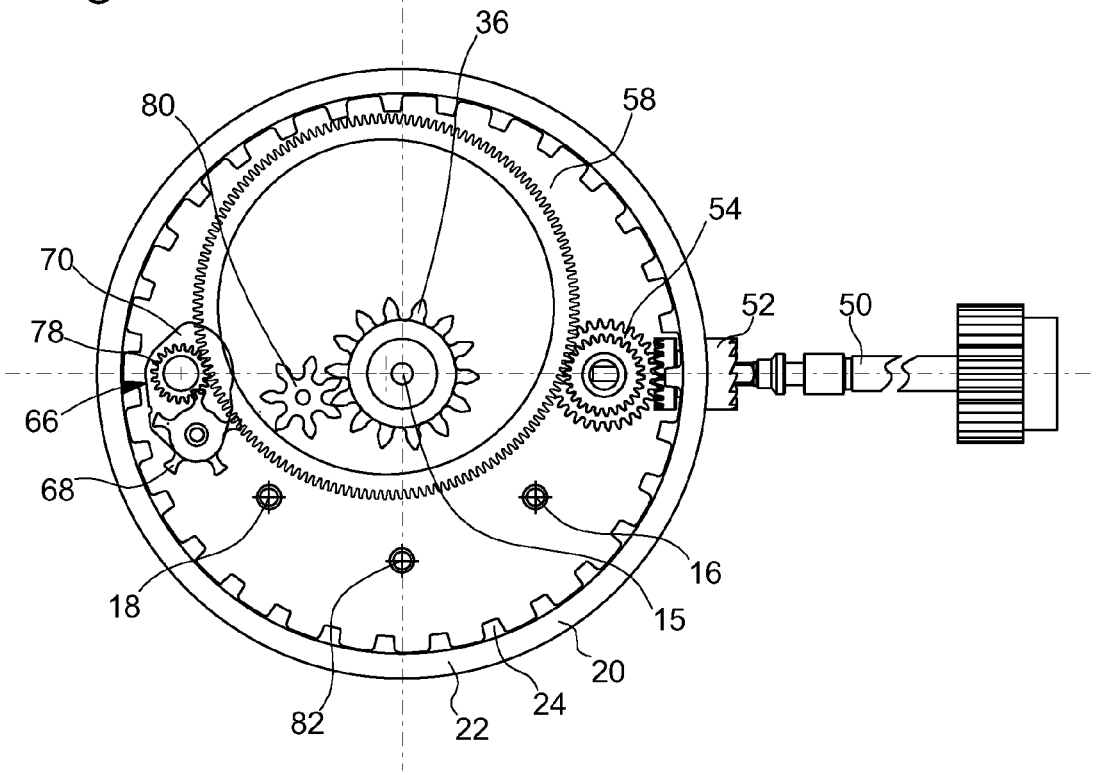

We will now refer to FIGS. 5 and 6, which illustrate variants of correction device 14 according to the invention.

The correction device 14 illustrated in FIG. 5 differs from the device illustrated in FIGS. 1 to 4, in that the diameter of intermediate corrector wheel 58 is smaller than the radius of date indicator 20 and in that it is off-centre relative to bottom plate 10, so as to occupy essentially the quarter located between 3 o'clock and 6 o'clock. The space freed at the centre of wheel 58 is essentially occupied by the minute counter arbour 16. It will be noted that arbour 15 at the centre of bottom plate 10 is excluded from this space, unlike the preceding embodiment. Double corrector 66 is located at 6 o'clock, i.e. between minute counter arbour 16 and hour counter arbour 18. Moreover, toothing 24 of intermediate corrector wheel 58 is located on its outer, not inner circumference and it is the inner circumference that guides wheel 58 in rotation. This arrangement is suitable for a bottom plate 10 that is pierced with a central arbour 15, and two off-centre arbours 16 and 18, respectively at 4 o'clock and 8 o'clock.

Finally, the correction device 14 illustrated in FIG. 6 differs from the preceding devices in that the diameter of intermediate corrector wheel 58 is smaller than the diameter of date indicator 20, but greater than its radius. Intermediate corrector wheel 58 is also off-centre relative to bottom plate 10, so as to occupy essentially the half comprised between 9 o'clock and 3 o'clock. The central arbour 15 is included in the space freed at the centre thereof. As in the preceding example, toothing 24 is an outer and not an inner toothing. The arrangement thus described is suitable for a plate that is pierced with four arbours 15, 16, 18, 82 located respectively at the centre, at 4 o'clock, 8 o'clock and 6 o'clock.

Other corrector device arrangements may be devised to suit requirements. All of these arrangements have in common a ring-shaped intermediate corrector wheel, fitted with an inner or outer toothing that is guided in rotation by one of its circumferences.

Of course, the corrector device according to the invention is not limited to the embodiments that have just been described and various simple alterations and variants could be envisaged by those skilled in the art, without departing from the scope of the invention as defined by the annexed claims.

It will be noted, in particular, that in the preceding description, intermediate corrector wheel 58 is guided in rotation by its outer or inner circumference. In a variant, intermediate corrector wheel 58 could be, for example, formed of a ring 60 fitted with a circular rib, engaged in a groove made in calendar plate 26.

It will also be noted that correction device 14 does not include a second intermediate wheel 56 in the variants illustrated in FIGS. 5 and 6. It will be clear, likewise, that the first intermediate wheel 54 is not indispensable to correction device 14, and that intermediate corrector wheel 58 can be meshed directly with sliding pinion 52.

The invention claimed is:

1. A timepiece comprising:

(a) a first rotatable ring-shaped display member and a bottom plate;

(b) a display mechanism for the timepiece; and (c) a device for correcting a time indication that is supplied by the display mechanism, wherein the device for correcting a time indication comprises (1) a winding stem arranged to occupy at least one time indication correcting position;

(2) a pinion mounted on the winding stem and secured thereto in rotation;

(3) an intermediate corrector wheel kinematically connected to the pinion when the stem is occupying the at least one time indication correcting position; and (4) a corrector wheel set that cooperates with the first rotatable ring-shaped display member and is actuated by the intermediate corrector wheel, wherein the intermediate corrector wheel is a ring with an inner circumference and an outer circumference, wherein at least one of the inner circumference and the outer circumference has teeth that mesh, at least indirectly, with the corrector wheel set, wherein the ring has space at the centre thereof adapted for housing parts of the timepiece, and wherein a diameter of the intermediate corrector wheel is close to a diameter of the first rotatable ring-shaped display member, thereby freeing space for housing parts of the timepiece and freeing space for the corrector wheel set away from the immediate vicinity of the winding stem.

2. The timepiece according to claim 1, wherein said intermediate corrector wheel is guided in rotation by one of the inner or outer circumferences thereof.

3. The timepiece according to claim 1, wherein said intermediate corrector wheel is guided in rotation by a rib secured to the ring.

4. The timepiece according to claim 1, wherein the correction device is mounted on the bottom plate through which several arbours pass, and wherein said intermediate corrector wheel is mobile in rotation about at least one of said arbours.

5. The timepiece according to claim 4, wherein the bottom plate is traversed by three arbours, one of which is centred relative to the bottom plate, and two others which are off-centre with respect to the bottom plate, and wherein said intermediate corrector wheel is mobile in rotation about said three arbours.

6. The timepiece according to claim 1, wherein the diameter of said intermediate corrector wheel is close to the diameter of the first ring-shaped display member and wherein the corrector wheel set is at approximately 9 o'clock on the bottom plate.

7. The timepiece according to claim 1, wherein said corrector wheel set is slidably mounted between a first position where the corrector wheel cooperates with said first ring-shaped display member and a second position where the corrector wheel cooperates at least indirectly with a second display member.

8. The timepiece according to claim 1, wherein said corrector wheel set is mounted on a lever.

9. The timepiece according to claim 1, wherein said corrector wheel set is slidably mounted in an oblong hole.

10. The timepiece according to claim 1, wherein said intermediate corrector wheel has a diameter that is a predetermined large fraction of a diameter of the bottom plate.

11. The timepiece according to claim 1, wherein the diameter of the intermediate corrector wheel is about ⅔ or more of a diameter of the bottom plate.

12. The timepiece according to claim 1, wherein said first ring-shaped display member is annular and the diameter of the first ring-shaped display member is about ⅔ or more of a diameter of the bottom plate.

13. The timepiece according to claim 1, wherein the diameter of the first ring-shaped display member and the diameter of the intermediate corrector wheel are each about ⅔ of a diameter of the bottom plate, wherein the diameter of the intermediate corrector wheel is smaller that the diameter of the first ring-shaped display member.

14. A timepiece comprising:

(a) a first rotatable ring-shaped display member and a bottom plate;

(b) a display mechanism for the timepiece; and (c) a device for correcting a time indication that is supplied by the display mechanism, wherein the device for correcting a time indication comprises (1) a winding stem arranged to occupy at least one time indication correcting position;

(2) a pinion mounted on the winding stem and secured thereto in rotation;

(3) an intermediate corrector wheel kinematically connected to the pinion when the stem is occupying the at least one time indication correcting position; and (4) a corrector wheel set that cooperates with the first rotatable ring-shaped display member and is actuated by the intermediate corrector wheel, wherein the intermediate corrector wheel is a ring with an inner circumference and an outer circumference, wherein at least one of the inner circumference and the outer circumference has teeth that mesh, at least indirectly, with the corrector wheel set, and wherein the ring has space at the centre thereof adapted for housing parts of the timepiece, and wherein the intermediate corrector wheel has a centre that is disposed off-centre relative to a centre of the bottom plate of the timepiece, thereby freeing space for housing parts of the timepiece and freeing space for the corrector wheel set away from the immediate vicinity of the winding stem.

15. The timepiece according to claim 14, wherein the correction device is mounted on the bottom plate through which several arbours pass, and wherein said intermediate corrector wheel is mobile in rotation about at least one of said arbours.

16. The timepiece according to claim 15, wherein said intermediate corrector wheel set is mounted about a single off-centre arbour, and wherein the diameter of said intermediate corrector wheel is close to a radius of the display member.

17. The timepiece according to claim 16, wherein said corrector wheel set is arranged at approximately 6 o'clock on the bottom plate.

* * * * *